US005379504A

United States Patent [19]

Sovitch et al.

[11] Patent Number: 5,379,504

[45] Date of Patent: Jan. 10, 1995

[54] APPARATUS FOR LOCATING SLIT ROLL ON A SKID

[76] Inventors: John P. Sovitch; Linda A. Sovitch, both of 1318 Porter St., Taylor, Pa. 18504

[21] Appl. No.: 176,642

[22] Filed: Jan. 3, 1994

Related U.S. Application Data

[62] Division of Ser. No. 964,291, Oct. 21, 1992, Pat. No. 5,274,898.

[51] Int. Cl.[6] ..... B25B 27/00

[52] U.S. Cl. ..... 29/270; 29/772; 81/451

[58] Field of Search ..... 29/270, 271, 772, 464; 81/451, 436, 463; 206/394, 303

[56] References Cited

U.S. PATENT DOCUMENTS

| | | | |
|---|---|---|---|
| 1,552,087 | 9/1925 | Smith | 29/270 |
| 2,525,316 | 10/1950 | Schiff | 173/91 X |
| 3,707,894 | 1/1973 | Stillwagon, Jr. | 81/451 X |
| 4,140,161 | 2/1979 | Russo et al. | 81/451 |
| 4,280,540 | 7/1981 | Meacham | 173/91 |
| 4,393,999 | 7/1983 | Forshee | 248/396 |
| 4,516,677 | 5/1985 | Rowland et al. | 206/394 |
| 4,557,409 | 12/1985 | Hecock et al. | 173/91 |
| 4,580,680 | 4/1986 | Wind | 206/386 |

*Primary Examiner*—Timothy V. Eley
*Assistant Examiner*—Khan V. Nguyen
*Attorney, Agent, or Firm*—Jacobson, Price, Holman & Stern

[57] ABSTRACT

A tool is provided for installing a positioning disk on a skid and the tool includes outer, intermediate and inner telescopingly engaged members with outer member including first and second ends in which tubular first and second abutment plugs, respectively, are removeably secured. One end of the intermediate member is disposed between the plugs and has a weight and impact sleeve secured thereabout for impacting with the plugs and the intermediate member projects outwardly out of the plug secured in the first end of the outer member and has diametrically opposite longitudinal slots formed therein through which the opposite ends of a diametric support shank carried by the inner member extend. The support shank ends are slidably received in the slots and have axial hand grips carried by the terminal ends thereof outwardly of opposite sides of the intermediate member, the latter also being rotably received within the outer member. The end of the inner member corresponding to the second end of the outer tubular member carries a screwdriver shank thereon for engagement with a central screw to be threadedly secured through the associated positioning disk and the plug secured in the first end of the outer tubular member includes peripherally spaced magnets recessed therein for magnetic attraction to ferrous shank-type fasteners spaced about the peripheral of the associated positioning plug.

5 Claims, 2 Drawing Sheets

FIG. 4
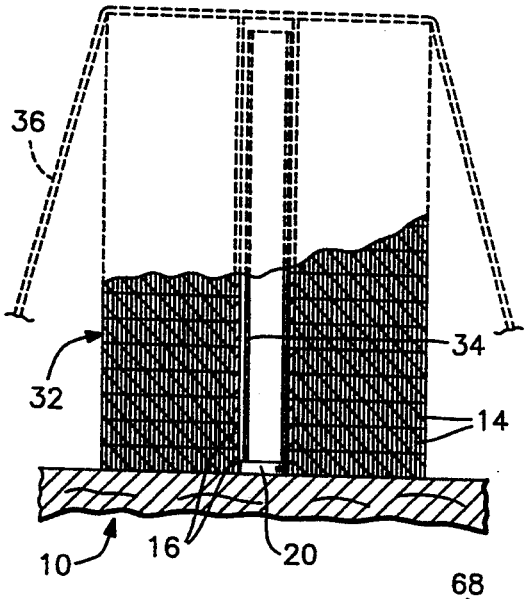
FIG. 3
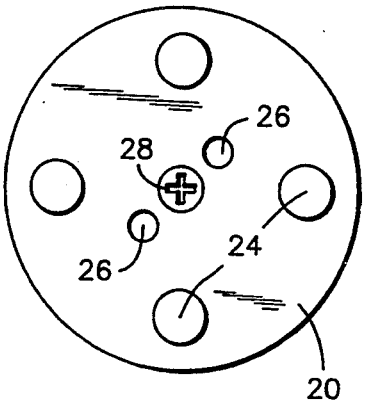
FIG. 5
FIG. 1
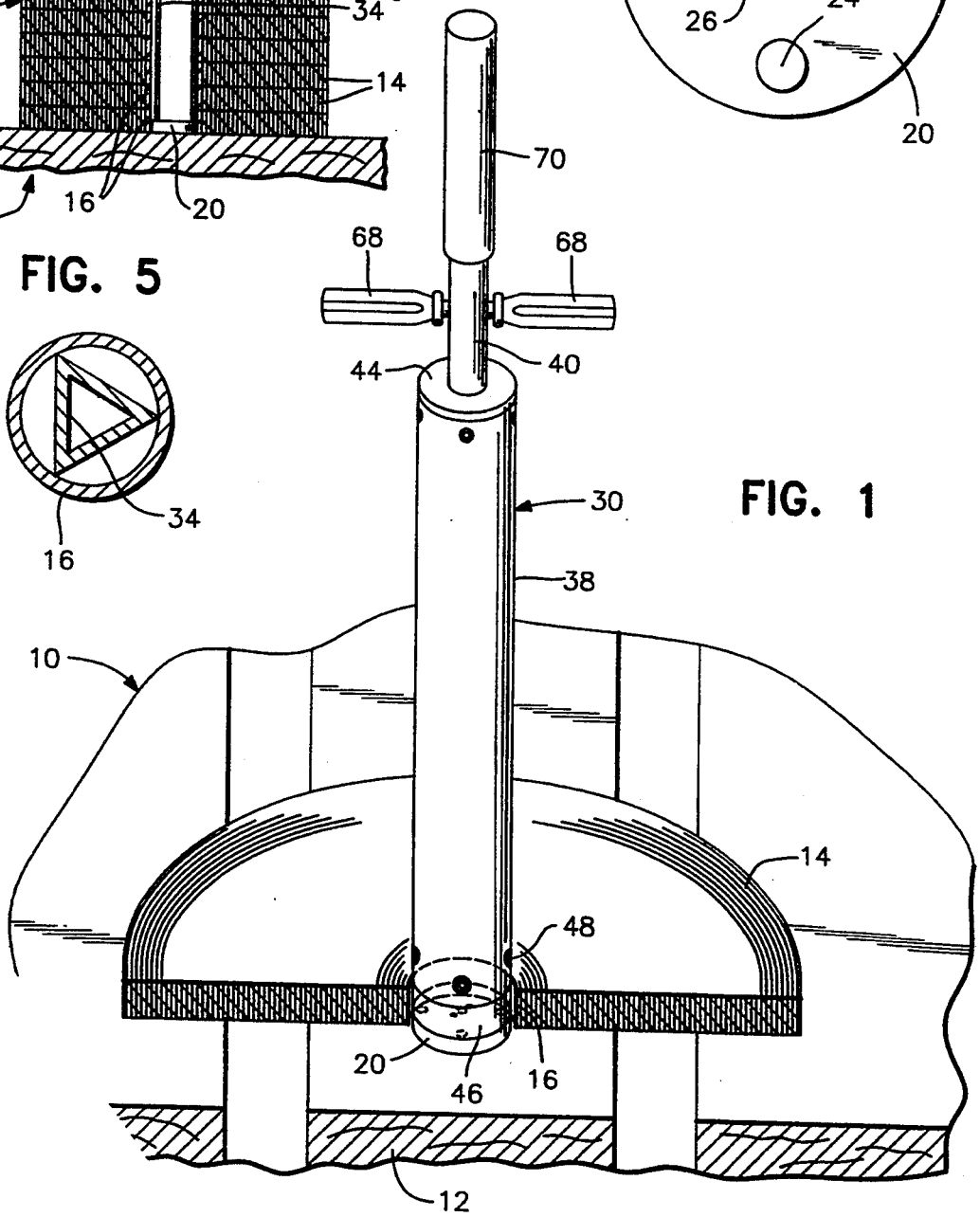

APPARATUS FOR LOCATING SLIT ROLL ON A SKID

This is a division of application Ser. No. 07/964,291, filed Oct. 21, 1992, now U.S. Pat. No. 5,274,898.

BACKGROUND OF THE INVENTION

1. Field of the Invention

This invention relates to a method and apparatus for locating multiple stacked slit rolls on a skid or pallet in order that the stack of slit rolls will not shift relative to each other or the skid or pallet upon which they are disposed during shipment.

2. Description of Related Art

Various different forms of pallet constructions heretofore have been provided with structure thereon for positively locating articles to be secured on the pallet for shipment from one location to another. In addition, various different forms of tools constructed for driving items into place also have been provided. Examples of these previous known structures are disclosed in U.S. Pat. Nos. 2,525,316, 4,280,540, 4,393,999, 4,516,677, 4,557,409 and 4,580,680. However, these previously known constructions and tools are not capable of modification of a conventional pallet for supporting a plurality of stacked slit rolls thereon against shifting during transport from one location to another.

SUMMARY OF THE INVENTION

The method and apparatus of the instant invention include a location disk for removable attachment to the upper service of the center board of a pallet or skid with the disk being of a size to be snugly received within the lowermost roll core of a stack of slit rolls to be mounted upon the skid. An impact tool is provided for removably securing the positioning disk on the upper surface of a skid and a more simplified form of impact tool may be provided for subsequently removing the disk from the skid.

The method and apparatus of the instant invention are provided to enable one or more stacks of slit rolls to be stationary mounted upon a skid or pallet. The rolls are formed by coating a wide web of raw paper with adhesive. The process starts out with a release liner to which adhesive is applied and the release liner then is laminated with a label stock and wound into a large roll. The next step is to slit the large roll into smaller width rolls wound on 3" inside diameter cores. These slit rolls are purchased by printing companies which in turn manufacture products (labels and stickers) which are seen and used in everyday life.

When a stack of the slit rolls are banded to a skid or pallet, the banding process has the tendency to damage the edges of the rolls, if the bands are over tightened in an attempt to secure the rolls to the skid or pallet for shipment against relative shifting or shifting relative to the skid. The slit rolls have a tendency to slip relative to each other and to slid relative to a skid or pallet inasmuch as the paper utilized in the slit rolls comprises silicone coated paper.

With the method of the instant invention the bottom slit roll on a skid or pallet is positively located thereon, an elongated upright center gusset is snugly telescoped downward through the core stack of slit rolls on the pallet or skid with the lower end of the gusset projecting into the core of the lower most slit roll and shrink plastic then may be used to enclose and retain the stack of slit rolls on the pallet, all without damaging the paper of the rolls.

The main object of this invention is to provide a method of mounting a stack of slit rolls upon a skid or pallet in a manner such that the stack of slit rolls will not shift relative to each other or the pallet or skid.

Another important object of this invention is to provide an apparatus for removably securing a slit roll positioning device on the upper surface of a skid or pallet over which the lower end of the core of the bottom roll of a stack of slit rolls may be telescoped.

A still further object of this invention is to provide an apparatus by which the slit roll positioning device also may be removed from the pallet or skid.

A final object of this invention to be specifically iterated herein is to provide a method and apparatus for positively locating a stack of slit rolls upon a skid or pallet with the method being easily carried out through the utilization of an apparatus which conforms to conventional forms of manufacture, which is of simple construction and easy to use so as to provide a device that will be economical feasible and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary perspective view of the upper side of a pallet or skid having a slit roll positioning disk mounted thereon, a fragmentarily illustrated slit roll positioned over the disk and the disk installation tool of the instant invention disposed over the disk in a position immediately subsequent to securement of the disk to the pallet or skid;

FIG. 3 is an enlarged top plan view of the positioning disk utilized to maintain a stack of slit rolls in position on a skid or pallet;

FIG. 4 is a fragmentary side elevational view of a stack of slit rolls in position on a pallet or skid with the lower portion of the stack of rolls and the underlying skid portion being broken away and illustrated in vertical section and the shrink wrap or film utilized to maintain the stack of rolls in position on the skid illustrated at phantom lines;

FIG. 5 is a horizontal sectional view illustrating the manner in which a vertical gusset is received through a roll core of a stack of slit rolls.

DETAILED DESCRIPTION OF THE INVENTION

Figure 2:
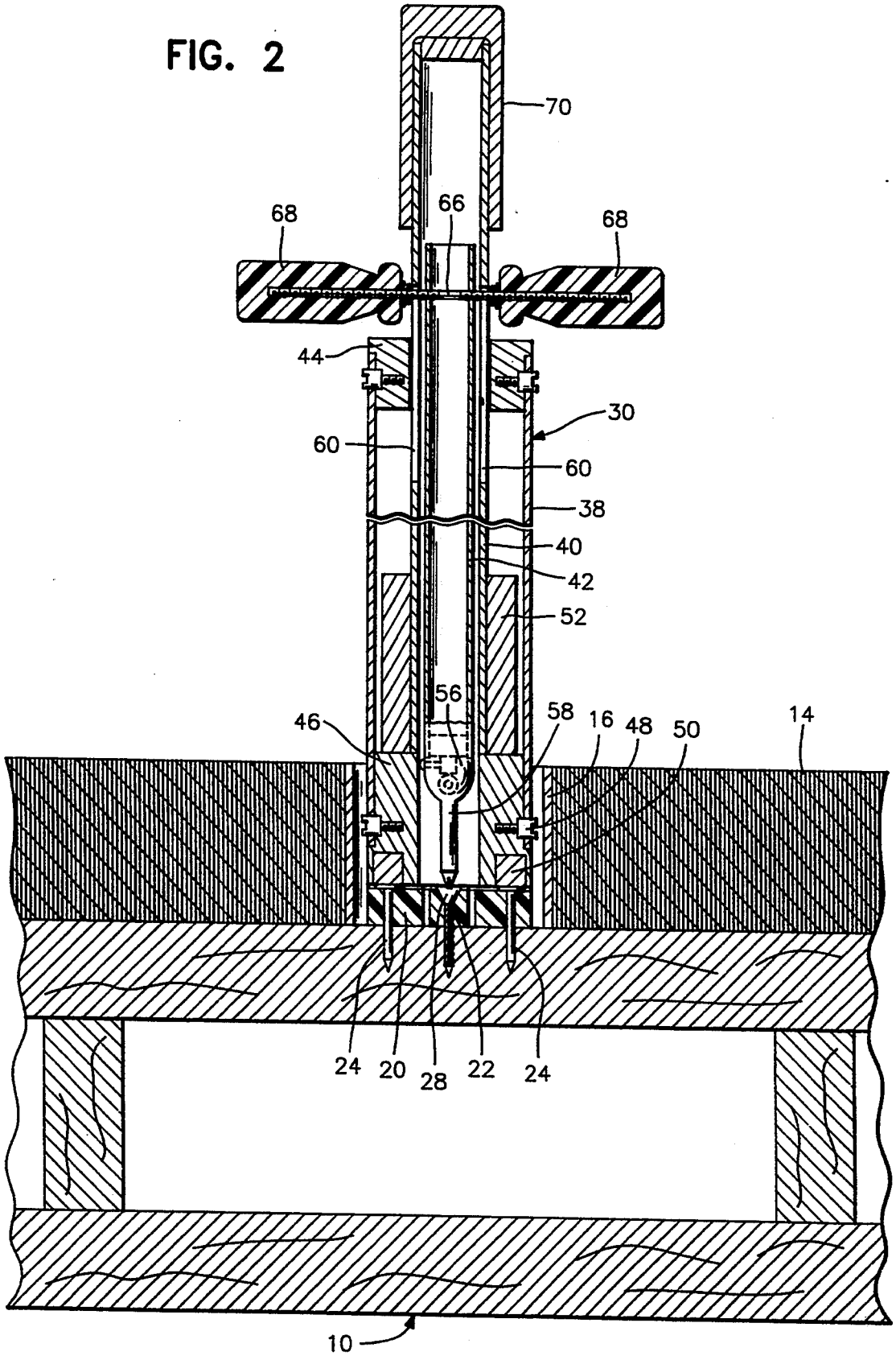
FIG. 2 is an enlarged fragmentary vertical sectional view taken substantially upon a plane passing through the longitudinal center line of the disk installation tool of the assemblage illustrated in FIG. 1.

Referring now more specifically to the drawings the numeral 10 generally designates a skid or pallet including a central board 12 upon which a stack of slit rolls 14 is to be stationary positioned.

Each slit roll 14 includes a cylindrical core 16 having silicone coated paper and label stock supported therefrom wound thereon. Each slit roll 14 has been cut from an initial long roll and may be on the order of 22" in outside diameter.

With attention now invited more specifically to FIGS. 1, 2 and 3 of the drawings, a locating disk 20 is provided. The locating disk 20 may be constructed of wood, plastic or any other suitable material and is of a size to be snugly, but loosely, received within the core 16. Further, the axial thickness of the disk 20 is considerably less than the axial length of the core 16. The disk 20 includes a central countersink bore 22 formed therethrough, a plurality of circumferentially spaced ferrous large headed nails 24 secured downwardly through circumferentially spaced outer peripheral portions of the disk 20 and a pair of diametrically opposite center smooth bores 26 formed through the disk 20.

Initially, the first slit roll 14 is properly positioned on the board 12 of the skid or pallet 10 and the disk 20 is moved downwardly through the core 16 of the roll 14 and secured in position on the board 12 through the utilization of the nails 24. A screw 28 is thereafter threaded downward through the center bore 22 and into the board 12. Thereafter, the remaining slit rolls 14 of the stack 32 of slit rolls are stacked on top of the bottom slit roll 14 in axial alignment therewith and a rigid tubular, triangular cross section, gusset 34 is telescoped downward through the cores 16 of the stack 32 with the lower end of the gusset 34 projecting appreciably downwardly into the lowermost core 16 and resting upon the top of the disk 20. Then, the stack 32 and skid or pallet 10 have shrink wrap 36 applied thereabout in order to maintain the stack 32 in position on the pallet or skid 10.

In order to install the disk 20, the tool 30 is utilized. The tool 30 includes outer, intermediate and inner tubular members 38, 40 and 42. The outer tubular member 38 includes shouldered opposite end tubular plugs 44 and 46 telescoped and removeably secured within the opposite ends thereof through the utilization of suitable radial fasteners 48, the tubular plug 46 including four circumferentially spaced and endwise outwardly facing magnets 50 recessed therein.

The intermediate tubular member 40 is loosely rotatably received through the tubular plug 44 and has a weight sleeve 52 secured about the end of the intermediate tubular member 40 disposed between the plugs 44 and 46, the inside diameter of the tubular plugs 46 being less than the outside diameter of the intermediate tubular member 40 and the outside diameter of the weight sleeve 52 being greater than the inside diameters of both the tubular plugs 44 and 46. Thus, the weight sleeve 52 is held captive within the outer tubular member 38 between the tubular plugs 44 and 46 and comprises an impact sleeve which may be impacted with the opposing axial ends of the tubular plugs 44 and 46.

The inner tubular member 42 is loosely received within the intermediate tubular member 40 and has a head 56 removably secured on the end thereof corresponding to the end of the outer tubular member 38 in which the tubular plug 46 is secured. The head 56 includes a screwdriver shank 58 supported therefrom.

The ends of the intermediate and inner tubular members 40 and 42 remote from the head 56 and the tubular plug 46 project outward of the tubular plug 44 and the intermediate tubular member 40 has diametrically opposite longitudinal slots 60 formed therein, a diametric support shaft 66 being secured through the end of the inner tubular member 42 projecting outward of the tubular plug 44 and having handle grips 68 removably secured to its opposite ends exteriorly of the inner tubular member 40, the support shaft 66 having its opposite end portions slidably received in the slots of 60. In addition, a hand grip 70 is telescoped over the end of the intermediate tubular member 40 which projects outward of the tubular plug 44.

The tool 30, after the initial slit roll 14 has been positioned on the pallet or skid 10 in the manner illustrated in FIG. 2, is utilized in applying the disk 20 to the board 12 within the core 16 of the slit roll 14. This is accomplished by raising the inner tubular member 42 relative to the outer and intermediate tubular members 38 and 40 to retract the screwdriver shank 58 upwardly through the interior of the tubular plug 46. Then, the disk 20 is applied to the end of the tubular plug 46 with the magnets 50 registered with the heads of the nails 24 and thus magnetically supporting the disk 20 from the tubular plug 46, the screw 28 having been initially started in the center bore 22.

Then, with the inner tubular member 42 still in an upwardly retracted position, the tool 30 is manipulated to downwardly displace the disk 20 and the lower end of the tool 30 through the center of the core 16 until the lower ends of the nails 24 rest upon the board 12.

The intermediate tubular member 40 is raised by the hand grip 70 and sharply downwardly displaced relative to the outer tubular member 38 to impact the weight sleeve 52 with the tubular plug 46. This is repeated as many times as necessary in order to downwardly displace the disk 20 into tight engagement with the board 12 and to drive the nails 24 into the board 12. Thereafter, the hand grips 68 are lowered to downwardly displace the screwdriver shank 58 into engagement with the screw 28 and the hand grips 68 are then utilized to turn the inner tubular member 42, as well as the intermediate tubular member 40, so as to screw the screw 28 downwardly into the board 12.

After the disk 20 has thus been secured to the board 12, the tool 30 is upwardly removed from the slit roll 14 resting upon the pallet or skid 10 and the remaining slit rolls 14 comprising the stack 32 of slit rolls are placed upon the first positioned slit roll in axial alignment therewith. After the desired stack 32 of slit rolls 14 has been properly positioned, a tubular, triangular cross section gusset 34 is downwardly telescoped through the cores 16 of the rolls 14 in the stack 32 and the shrink film or wrap 36 is secured about the stack 32 and the pallet or skid 10.

After thus being mounted upon the skid or pallet 10, the stack 32 is positively located against shifting relative to the pallet or skid 10 and may be conventionally transported to a distant purchaser of the slit rolls 14.

When the purchaser desires to remove the rolls 14 from the pallet of skid 10, the shrink wrap or film is removed, the interior gusset 34 is removed and most of the rolls 14 comprising the stack 32 may be removed. Thereafter, an impact tool (not shown), including a threaded shank, has its threaded shank threaded downwardly through one of the two smooth bores 26 in tight threaded engagement with the disk 20 and the impact tool is operated to apply upward impact forces on the disk 20 in order to effect its removal.

The foregoing is considered illustrative only of the principles of the invention. Further, since numerous modifications and changes will readily occur to those skilled in the art, it is not desired to limit the invention to the exact construction and operation shown and described, and accordingly, all suitable motivations and equivalence may be resorted to, falling within the scope of the invention.

What is claimed as new is as follows:

1. An impact tool for supporting, positioning and anchoring a positioning disk upon a skid, said tool including relatively telescopingly engaged elongated outer and intermediate members and an inner elongated member telescoped within said intermediate member, said outer tubular member including first and second ends having first and second tubular plugs, respectively, secured therein and including opposing and remote ends, the end of said intermediate tubular member corresponding to said second end of said outer tubular member being disposed between said first and second tubular plugs and having an exterior weight and impact sleeve secured thereon, the inside diameter of said second tubular plug being less than the outside diameter of said weight and impact sleeve and the inside diameter of said first tubular plug being less than the outside diameter of said weight and impact sleeve whereby selective longitudinal reciprocation of said intermediate tubular member relative to said outer tubular member will impact said weight and impact sleeve with either of the opposing ends of said first and second tubular plugs, the ends of said intermediate and inner members corresponding to said first end of said outer tubular member projecting endwise outwardly of said first end of said outer tubular member, said intermediate tubular member including diametrically opposite longitudinal slots formed therein, said inner member including a diametric support shaft whose opposite end portions project through and are slidably received in said slots and have hand grips mounted thereon exteriorly of said intermediate tubular member, and the end of said inner member corresponding to said second end of said outer tubular member including a rotary torque transfer shank thereon projectable outwardly through the interior of said tubular plug at said second end of said outer tubular member for rotary torque transfer to a threaded shank-type fastener.

2. The tool of claim 1 wherein the end of second tubular plug facing outwardly of said second end of said outer tubular member includes peripherally spaced magnets recessed therein for magnetic attraction to ferrous shank-type fasteners spaced about the periphery of a positioning disk with which said second end of said outer tubular member is axially aligned and abutted.

3. The tool of claim 1 wherein the end of said inner member remote from said second end of said outer tubular member includes an axial hand grip thereon.

4. The tool of claim 1 wherein said first and second tubular plugs are removeably secured in said first and second ends of said outer tubular member.

5. The tool of claim 1 wherein said intermediate tubular member is rotatably received through said first tubular plug.

* * * * *